United States Patent [19]

Trayner

[11] 4,286,522

[45] Sep. 1, 1981

[54] LATCH DEVICES

[75] Inventor: Brian T. Trayner, Stevenage, England

[73] Assignee: British Aerospace Public Limited Company, London, England

[21] Appl. No.: 44,159

[22] Filed: May 31, 1979

[30] Foreign Application Priority Data

May 31, 1978 [GB] United Kingdom ..... 25704/78

[51] Int. Cl.[3] ..... F42C 15/34

[52] U.S. Cl. ..... 102/255; 102/222

[58] Field of Search ..... 102/255, 256, 254, 222

[56] References Cited

U.S. PATENT DOCUMENTS

| | | | |
|---|---|---|---|
| 2,789,508 | 4/1957 | Rove et al. | 102/255 |
| 3,285,177 | 11/1966 | Lohmann | 102/255 |
| 3,313,236 | 4/1967 | Lohmann | 102/256 |
| 4,090,450 | 5/1978 | Nygards | 102/254 |

*Primary Examiner*—David H. Brown

*Attorney, Agent, or Firm*—Cushman, Darby & Cushman

[57] ABSTRACT

A latch device in which movement of a shutter from a first to a second position is controlled by two latches in turn controlled by separate timers, the arrangement being such as to prevent the shutter reaching the second position unless the latches are operated in the correct sequence and the time between operation is above a nominal small value.

4 Claims, 3 Drawing Figures

LATCH DEVICES

This invention relates to latch devices of the mechanical type which are employed to ensure the safety of a mechanism or system and in particular to a safety latch device controlled by a time conscious medium.

In the past it has proved difficult to use electronic timing devices in safety and arming units because of their inherent failure modes. An object of the present invention is to overcome these difficulties to an extent where a satisfactory low probability of failing unsafe can be ensured.

According to the present invention the latch device includes, in combination, a movable member arranged for movement between first and second positions, biasing means biasing said member towards the second position, a first movable latch normally retaining said member in the first position, and a second movable latch normally preventing movement of said member beyond an intermediate position between said first and second positions, unlatching of said second latch being arranged to allow continued movement of said member only if said member has already moved beyond a predetermined fail-safe position as a result of unlatching of the first latch.

Further features of the invention will appear from the following description with reference to the accompanying drawing where the latch device is in the form of a mechanical shutter which is normally interposed between a detonator and a main explosive charge.

Figure 1:
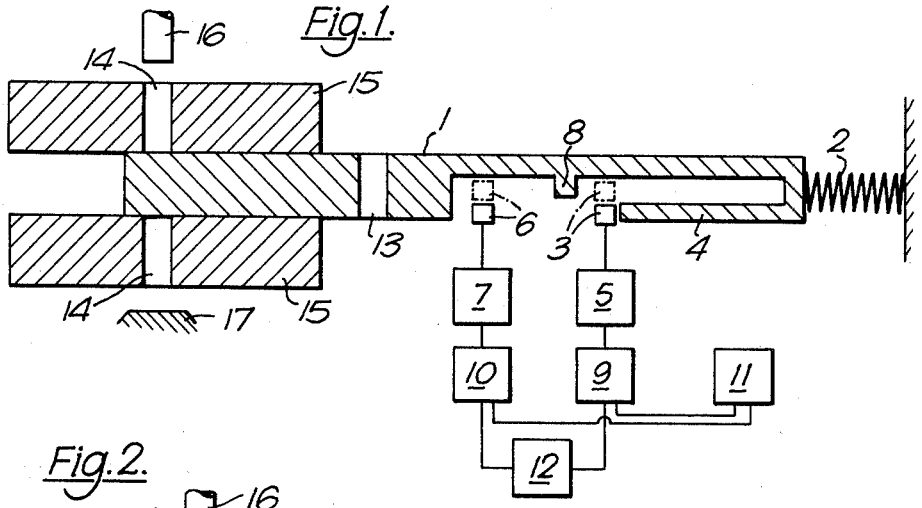
FIG. 1 shows the device in the unarmed position.

Referring now to the drawing, the shutter 1 is normally retained in the unarmed position as shown in FIG. 1 against the force of a biasing spring 2 by a movable latch 3 which in the safe position as shown in full engages an abutment 4 integral with the shutter. The latch is movable to the position shown dotted where it disengages the abutment by an explosive device shown diagrammatically at 5.

A further movable latch 6 may be moved from the safe position shown in full to the position shown dotted by a second explosive device 7. In the safe position this latch lies in the path of the abutment 4; in the position shown dotted it lies in the path of a further abutment 8 also integral with the shutter. The explosive devices 5 and 7 are controlled by electronic timers 9 and 10 respectively which are fed from a common power supply 11. a single starter 12 being provided for initiating simultaneous starting of the two timers.

If the specified time for arming is between t1 and t4 the timer 9 will be designed to operate between t1 and t2 and the timer 10 between t3 and t4 where t2 is less than t3, the abutments 4 and 8 being so positioned with respect to the latches 3 and 6 that the shutter 1 can only move to the armed position if the two timers operate to initiate action of the latches in the correct sequence and the time between their operation is above some small nominal value.

Figure 2:
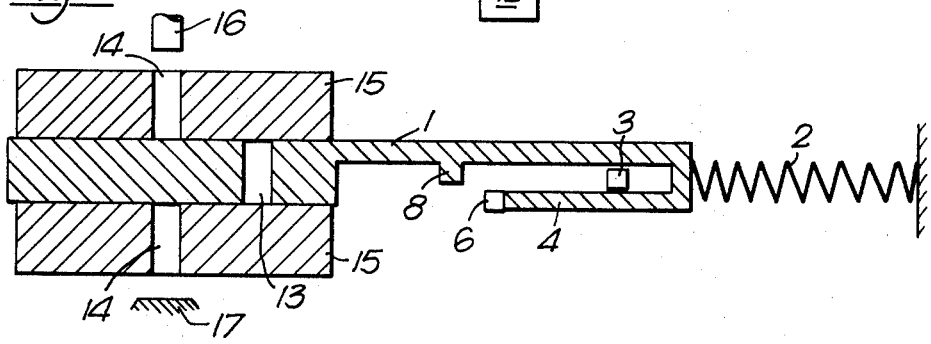
FIG. 2 shows the device in an intermediate position, whilst
Figure 3:
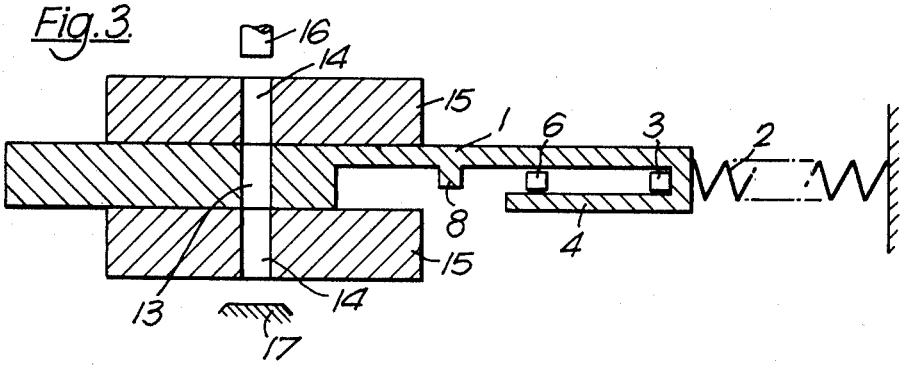
FIG. 3 shows the device in the armed position.

In operation, if the latches are operated in the correct sequence i.e. latch 3 first, then the shutter will move to an intermediate position as shown in FIG. 2 where the abutment 4 will engage latch 6. Operation of the latch 6 will then allow the shutter to move to the armed position as shown in FIG. 3 where a transverse aperture 13 in the shutter lies in alignment with holes 14 in the fixed guide plates 15. In this position a plunger 16 may pass through the aligned holes to strike the main explosive charge 17.

If on the other hand, latch 6 is operated before or simultaneously with latch 3 then the abutment 8 will engage the latch 6 inhibit the device in a fail-safe position. Latch 6 will also prevent movement of the shutter to the armed position if it is operated before the shutter has moved sufficiently to take the abutment 8 past this latch. This movement time may be increased by fitting the shutter with a gas damper or a clutter mechanism but obviously for reliable operation the time should not exceed t3—t2.

From the foregoing it will be apparent that no single independent failure of the timers 9 and 10 will allow premature arming and also that simultaneous failure of the two timers such as might be caused by a voltage surge in the common power supply giving rise to premature operation of the latches will cause the device to fail safe.

It will be understood that the device is not limited in its application to safety and arming units but may be used in any other application requiring similar safety features.

It will also be understood that the latches 3 and 6 may be actuated by other means such as for example a gas filled cylinder, an electric solenoid or a bi-metallic strip.

I claim:

1. A latch device including, in combination:

a movable member arranged for movement between first and second positions via fail-safe and intermediate positions successively;

biasing means biasing said member towards said second position;

first and second latch means each movable from an initial position to an activated position;

first abutment means carried by said member and engageable with said first latch means when in its initial position to retain said member in said first position and disengageable from said first latch means when in its activated position to allow movement of said movable member towards said second position, and said first abutment means being engageable with said second latch means when in its initial position to prevent movement of said member past said intermediate position and disengageable from said second latch means when in its activated position to allow movement of said member towards said second position; and second abutment means carried by said member in spaced relation to said first abutment means and engageable with said second latch means when in its activated position to prevent movement of said member past said fail-safe position if said member is at said first position at the time when said second latch means moves from its initial position to its activated position, whereby said member is allowed to move to said second position only if said member has moved past said fail-safe position at the time when said second latch means moves from its initial to its activated position.

2. A latch device according to claim 1 including separate activating means for operating said latches, separate electronic timers for initiating operation of said activating means, and a single start means for initiating starting of said timers.

3. A latch device according to claim 2 wherein said timers are supplied from a common power source.

4. A latch device according to claims 2, 3 or 1 including a movable detonator for an explosive charge, said detonator being controlled by said movable member so as to move to detonate the charge only when said member is in said second position.

* * * * *